US009212619B2

(12) United States Patent
Chae et al.

(10) Patent No.: US 9,212,619 B2
(45) Date of Patent: Dec. 15, 2015

(54) METHOD FOR PREVENTING MISDIAGNOSIS OF OIL LEVEL SENSOR

(71) Applicants: Hyundai Motor Company, Seoul (KR); Kia Motors Corporation, Seoul (KR)

(72) Inventors: Min Gyun Chae, Whasung-Si (KR); Jong Kil Lim, Whasung-Si (KR); Hong Woon Jang, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 101 days.

(21) Appl. No.: 14/055,696

(22) Filed: Oct. 16, 2013

(65) Prior Publication Data

US 2014/0172267 A1 Jun. 19, 2014

(30) Foreign Application Priority Data

Dec. 17, 2012 (KR) ..... 10-2012-0147766

(51) Int. Cl.

*F02D 45/00* (2006.01)
*F01M 11/12* (2006.01)
*F02D 41/22* (2006.01)

(52) U.S. Cl.

CPC ..... *F02D 45/00* (2013.01); *F01M 11/12* (2013.01); *F02D 41/222* (2013.01); *F02D 2200/024* (2013.01)

(58) Field of Classification Search

CPC . F02D 45/00; F02D 2200/024; F02D 41/222; F02M 11/12
USPC ..... 701/101; 73/114.55–114.56, 291–301
See application file for complete search history.

(56) References Cited

U.S. PATENT DOCUMENTS

| | | | | |
|---|---|---|---|---|
| 5,282,386 | A * | 2/1994 | Niemczyk et al. | 73/292 |
| 5,382,942 | A * | 1/1995 | Raffa et al. | 340/457.4 |
| 5,831,154 | A * | 11/1998 | Guertler et al. | 73/114.56 |
| 7,260,982 | B2 * | 8/2007 | Utz et al. | 73/114.55 |
| 7,281,414 | B2 * | 10/2007 | Cho | 73/54.24 |

FOREIGN PATENT DOCUMENTS

| | | | |
|---|---|---|---|
| JP | 2004-156454 | A | 6/2004 |
| JP | 2012-184701 | A | 9/2012 |
| KR | 10-0520559 | B1 | 10/2005 |
| KR | 10-0690241 | B1 | 3/2007 |
| KR | 10-0793701 | B1 | 11/2008 |

* cited by examiner

*Primary Examiner* — Stephen K Cronin
*Assistant Examiner* — Susan E Scharpf
(74) *Attorney, Agent, or Firm* — Morgan, Lewis & Bockius LLP

(57) ABSTRACT

A method for preventing misdiagnosis of an oil level sensor may include determining whether a driving status of a vehicle satisfies a first diagnosis condition, a second diagnosis condition or both. When the first diagnosis condition is satisfied, the method may include measuring oil levels, calculating a first average of the measured oil levels, and comparing the calculated first average of the measured oil levels with a predetermined reference oil level. When the second diagnosis condition is satisfied, the method may include measuring oil levels, calculating a second average of the measured oil levels, and comparing the calculated second average of the measured oil levels with the predetermined reference oil level. The method may also include warning an excess of oil when the first, the second or both first and second averages of the measured oil levels are higher than the predetermined reference oil level.

8 Claims, 4 Drawing Sheets

[Related Art]

[Related Art]

METHOD FOR PREVENTING MISDIAGNOSIS OF OIL LEVEL SENSOR

CROSS-REFERENCE TO RELATED APPLICATION

The present application claims priority of Korean Patent Application Number 10-2012-0147766 filed Dec. 17, 2012, the entire contents of which application are incorporated herein for all purposes by this reference.

BACKGROUND OF INVENTION

1. Field of Invention

The present invention relates to a method for preventing misdiagnosis of an oil level sensor. More particularly, the present invention relates to a method for preventing misdiagnosis of an oil level sensor which can prevent misdiagnosis of an oil level sensor at the beginning of oil change, at the start after key-on and while a vehicle travels.

2. Description of Related Art

There may be misdiagnosis due to a difference between the actual oil level in an oil pan and the oil level measured by an oil level sensor at the beginning of oil change and at the starting after key-on, because of the structure of an oil level sensor and the sensing characteristic of an oil level.

FIGS. 3 and 4 are diagrams illustrating a malfunction or misdiagnosis of an oil sensing system. Referring to FIGS. 3 and 4, oil contained in an oil pan 20 flows inside through an oil injection hole 12 of an oil level sensor 10 and the oil level is measured by sending out an ultrasonic wave and calculating the reciprocation time of the ultrasonic wave from the oil level and the oil level sensor 10.

FIG. 3 shows the difference between the oil level sensor 10 and the actual oil level in the initial injection of oil, in which the oil level value in the oil level sensor 10 to the actual oil level turns out to be relatively small or lower, because the diameter of the oil injection hole 12 is small.

FIG. 4 shows the difference between the oil level sensor 10 and the actual oil level at the beginning of starting after stopping, in which, on the contrary, the oil level value in the oil level sensor 10 to the actual oil level may turn out to be relatively large or higher.

That is, there is possibility of misdiagnosis because the measured oil level is different from the actual oil level even if the oil level is measured in real time for a predetermined time.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a method for preventing misdiagnosis of an oil level sensor having advantages of being able to prevent misdiagnosis of an oil level sensor, when there is a possibility of difference between the actual oil level and a level measured by the oil level sensor, as at the beginning of changing oil or starting after key-on or while traveling.

Various aspects of the present invention provide a method for preventing misdiagnosis of an oil level sensor, including (a) determining whether a driving status of a vehicle satisfies a first diagnosis condition, a second diagnosis condition or both; when the driving status of the vehicle satisfies the first diagnosis condition: (b) measuring oil levels, (c) calculating a first average of the measured oil levels, and (d) comparing the calculated first average of the measured oil levels with a predetermined reference oil level; when the driving status of the vehicle satisfies the second diagnosis condition: (e) measuring oil levels, (f) calculating a second average of the measured oil levels, and (g) comparing the calculated second average of the measured oil levels with the predetermined reference oil level; and (h) warning an excess of oil when the first, the second or both first and second averages of the measured oil levels are higher than the predetermined reference oil level.

The first diagnosis condition in the step (a) may be considered satisfied, when an oil temperature is measured and the measured oil temperature is over a predetermined first oil temperature and under a predetermined second oil temperature, and when a number of revolutions of an engine is measured and the measured number of revolutions is over a predetermined first number of revolutions and under a predetermined second number of revolutions.

The second diagnosis condition in step (a) may be considered satisfied, when an oil temperature is measured and the measured oil temperature is over a predetermined third oil temperature and under a predetermined fourth oil temperature, and when a number of revolutions of an engine is measured and the measured number of revolutions is over a predetermined third number of revolutions and under a predetermined fourth number of revolutions.

The predetermined first oil temperature may be lower than the predetermined third oil temperature. The predetermined second oil temperature may be lower than the predetermined fourth oil temperature.

The predetermined first number of revolutions of an engine may be smaller than the predetermined third number of revolutions of an engine. The predetermined second number of revolutions may be substantially the same as the predetermined fourth number of revolutions.

The measuring oil levels in step (b) may be conducted for a predetermined first reference time and the calculating the first average of the measured oil levels in step (c) may be performed on the oil levels measured over the predetermined first reference time. A time accumulated from a start of an engine may be compared with the predetermined first reference time to determine whether the accumulated time exceeds the predetermined first reference time.

The measuring oil levels in step (e) may be conducted for a predetermined second reference time and the calculating the second average of the measured oil levels in step (f) may be performed on the oil levels measured over the predetermined second reference time.

The measuring oil levels in step (e) may be conducted for a predetermined traveling distance of the vehicle and the calculating the second average of the measured oil levels in step (f) may be performed on the oil levels measured over the predetermined traveling distance of the vehicle.

According to the present invention, it is possible to prevent misdiagnosis of an oil level sensor, where there is a possibility of a difference between the actual oil level and the level measured by the oil level sensor, as at the beginning of oil change and at the starting of a vehicle after key-on or while the vehicle travels.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
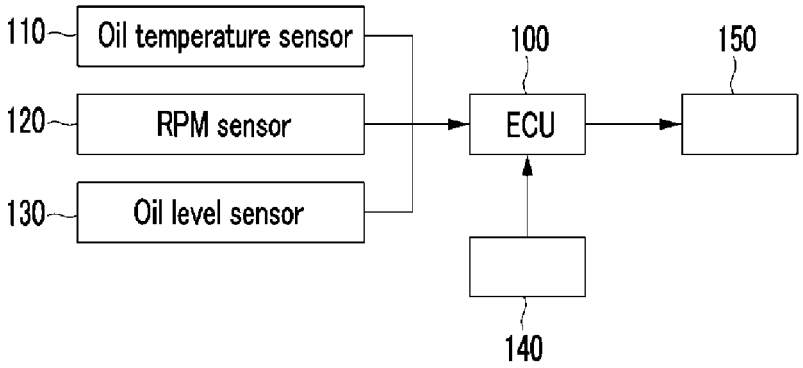
FIG. 1 is a diagram showing an exemplary oil sensing system that is used for preventing misdiagnosis of an oil level sensor according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Like reference numerals are given to like components throughout the specification. In the drawings, the thickness of layers, films, panels, regions, etc., are exaggerated for clarity.

The case in which it is represented that each part such as a layer, a film, an area, a plate, or the like, is "on" another part is intended to include not only the case in which each part is "directly on", but also the case in which the other part is between each part and another part. In contrast, when an element is referred to as being "directly on" another element, there are no intervening elements present.

Throughout the specification, unless explicitly described to the contrary, the word "comprise" and variations such as "comprises" or "comprising", will be understood to imply the inclusion of stated elements but not the exclusion of any other elements.

FIG. 1 is a diagram showing an oil sensing system that is used for preventing misdiagnosis of an oil level sensor according to various embodiments of the present invention. Referring to FIG. 1, an oil sensing system includes an oil temperature sensor 110 that measures oil temperature and outputs a corresponding signal, an RPM sensor 120 that measures the number of revolutions of an engine, that is, the RPM and outputs a corresponding signal, an oil level sensor 130 that measures the current amount of oil in the engine, and a control unit (ECU) 100 that receives the signals from the oil temperature sensor 110, the RPM sensor 120, and the oil level sensor 130 and controls an alarm 150 to output an alarm message, when the signals satisfy predetermined conditions as the result of comparing the signals with a predetermined map 140.

Figure 2:
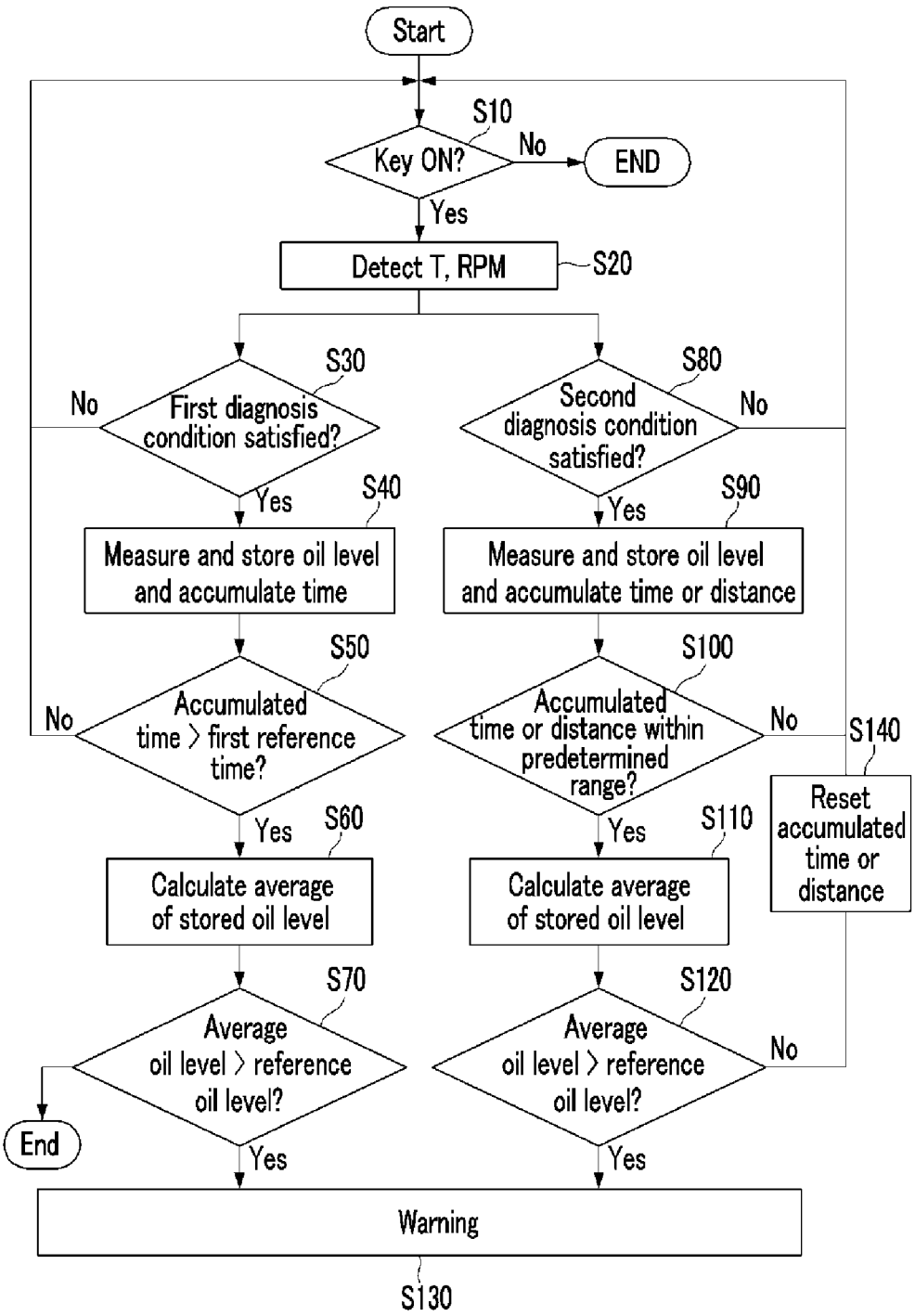
FIG. 2 is a flowchart illustrating an exemplary method for preventing misdiagnosis of an oil level sensor according to the present invention.
Figure 3:
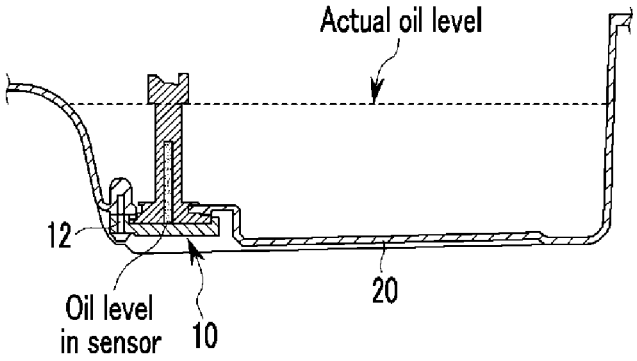
FIGS. 3 and 4 are diagrams illustrating a malfunction or misdiagnosis of an oil sensing system.
Figure 4:
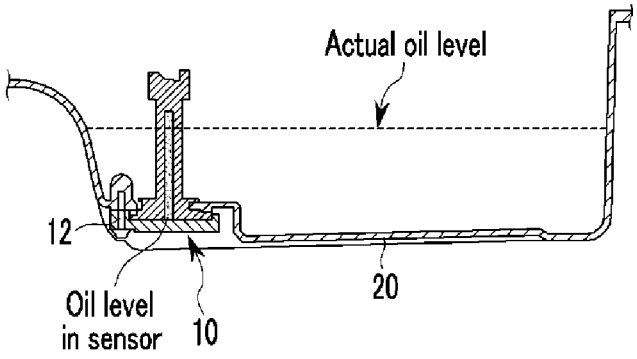

FIG. 2 is a flowchart illustrating a method for preventing misdiagnosis of an oil level sensor according to various embodiments of the present invention. Hereinafter, a method for preventing misdiagnosis of an oil level sensor is described with reference to FIGS. 1 and 2.

The control unit 100 determines whether an ignition switch has been turned on (S10), and receives the current oil temperature and RPM information from the oil temperature sensor 110 and the RPM sensor 120 (S20), when the ignition switch has been turned on.

The control unit 100 determines whether there is a malfunction or misdiagnosis of the oil level sensor at present through two routes based on the measured current oil temperature and RPM information.

The control unit 100 determines whether the driving status of a vehicle satisfies a first diagnosis condition (S30), and measures the oil level with the oil level sensor 130, when the first diagnosis condition is satisfied (S40). Then, the control unit 100 calculates the average of the measured oil levels (S60).

The first diagnosis condition may be considered satisfied, when the oil temperature is measured and the measured oil temperature is over a predetermined first oil temperature and under a predetermined second oil temperature and when the number of revolutions of the engine is measured and the measured number of revolutions of the engine is over a predetermined first number of revolution of the engine and under a predetermined second number of revolutions of the engine.

In S30, the control unit 100 stores the measured oil levels and accumulates a time or times. When the accumulated time is a predetermined first reference time or more (S50), the average of the measured oil levels is calculated (S60).

The first reference time may be the time accumulated only for a predetermined time from the start of the engine, and for example, the average of the oil levels measured for about 10 minutes from the start of the engine may be calculated.

The control unit 100 warns of an excess of oil through the alarm 150, when the calculated average of oil levels is larger or higher than a reference oil level stored in the map 140, as the result of comparing them (S70), and finishes the control logic based on the first diagnosis condition, when the calculated average of oil levels is not larger or higher than the reference oil level stored in the map 140. The stored reference oil level may be set on the basis of an appropriate amount oil for the engine.

The control unit 100 determines whether the driving status of a vehicle satisfies the second diagnosis condition (S80), simultaneously or in parallel with the control logic based on the first diagnosis condition.

The second diagnosis condition may be considered satisfied, when the oil temperature is measured and the measured oil temperature is over a predetermined third oil temperature and under a predetermined fourth oil temperature, and when the number of revolutions of the engine is measured and the measured number of revolutions of the engine is over a predetermined third number of revolution of the engine and under a predetermined fourth number of revolutions of the engine.

The control unit 100 measures and stores the oil level and simultaneously accumulates the elapsed time or the traveling distance of the vehicle (S90), when the second diagnosis condition is satisfied.

Thereafter, the control unit 100 determines whether the accumulated time or distance is within a predetermined range (S100). The predetermined range may be about 100 minutes or 100 km.

The control unit 100 calculates the average of the stored oil levels, when the accumulated time or distance is within the predetermined range (S110), compares the calculated average of the oil levels with a reference oil level stored in advance (S120), warns of an excess of oil through the alarm 150 (Sl30), when the calculated average of the oil levels is larger or higher than the reference oil level, and resets the accumulated time or distance and repeats the control logic based on the second diagnosis condition, when the calculated average of the oil levels is not larger or higher than the reference oil level stored in the map 140 (S140).

The predetermined first oil temperature may be set to be lower than the predetermined third oil temperature and the second oil temperature may be set to be lower than the predetermined fourth oil temperature.

For example, the first oil temperature may be 0 degree Celsius, the second oil temperature may be 90 degrees Celsius, the third oil temperature may be 60 degrees Celsius, and the fourth oil temperature may be 110 degrees Celsius.

The predetermined first number of revolutions of an engine may be set to be smaller than the predetermined third number of revolutions of an engine.

For example, the predetermined first number of revolutions may be set to be 0 RPM, the predetermined third number of revolutions may be set to be 1000 RPM, and the second and fourth RPMs may be set to be 2800 RPM in consideration of the possibility of misdiagnosis due to rapid acceleration of a vehicle.

That is, the first diagnosis condition is a condition from which it is possible to determine whether there is a malfunction or misdiagnosis in the oil level sensor at the beginning of the start of an engine or right after oil is changed and the second diagnosis condition is a condition from which it is possible to determine whether there is a malfunction or misdiagnosis in the oil level sensor while a vehicle travels.

The method for preventing misdiagnosis of an oil level sensor according to the present invention can ensure reliability by measuring the oil level in real time in accordance with the first diagnosis condition, determining whether oil is excessive by comparing the average with the stored reference value, and converting to a specific logic after the vehicle reaches a predetermined level of traveling.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for preventing misdiagnosis of an oil level sensor, the method comprising:

(a) determining whether a driving status of a vehicle satisfies a first diagnosis condition, a second diagnosis condition or both;

when the driving status of the vehicle satisfies the first diagnosis condition:

(b) measuring oil levels, (c) calculating a first average of the measured oil levels, and (d) comparing the calculated first average of the measured oil levels with a predetermined reference oil level;

when the driving status of the vehicle satisfies the second diagnosis condition:

(e) measuring oil levels, (f) calculating a second average of the measured oil levels, and (g) comparing the calculated second average of the measured oil levels with the predetermined reference oil level; and (h) warning an excess of oil when the first, the second or both first and second averages of the measured oil levels are higher than the predetermined reference oil level, wherein the first diagnosis condition in step (a) is satisfied, when an oil temperature is measured and the measured oil temperature is over a predetermined first oil temperature and under a predetermined second oil temperature, and when a number of revolutions of an engine are measured and the measured number of revolutions is over a predetermined first number of revolutions and under a predetermined second number of revolutions, wherein the second diagnosis condition in step (a) is satisfied, when an oil temperature is measured and the measured oil temperature is over a predetermined third oil temperature and under a predetermined fourth oil temperature, and when a number of revolutions of an engine are measured and the measured number of revolutions is over a predetermined third number of revolutions and under a predetermined fourth number of revolutions, wherein the predetermined second number of revolutions is substantially the same as the predetermined fourth number of revolutions.

2. The method of claim 1, wherein the predetermined first oil temperature is lower than the predetermined third oil temperature.

3. The method of claim 1, wherein the predetermined second oil temperature is lower than the predetermined fourth oil temperature.

4. The method of claim 1, wherein the predetermined first number of revolutions is smaller than the predetermined third number of revolutions.

5. The method of claim 1, wherein the measuring oil levels in step (b) is conducted for a predetermined first reference time and the calculating the first average of the measured oil levels in step (c) is performed on the oil levels measured over the predetermined first reference time.

6. The method of claim 5, wherein a time accumulated from a start of an engine is compared with the predetermined first reference time to determine whether the accumulated time exceeds the predetermined first reference time.

7. The method of claim 1, wherein the measuring oil levels in step (e) is conducted for a predetermined second reference time and the calculating the second average of the measured oil levels in step (f) is performed on the oil levels measured over the predetermined second reference time.

8. The method of claim 1, wherein the measuring oil levels in step (e) is conducted for a predetermined traveling distance of the vehicle and the calculating the second average of the measured oil levels in step (f) is performed on the oil levels measured over the predetermined traveling distance of the vehicle.

* * * * *